United States Patent [19]

Graham

[11] 4,306,935

[45] Dec. 22, 1981

[54] MANUFACTURE OF INSULATING PRODUCTS

[75] Inventor: Robert Graham, Durham, Great Britain

[73] Assignee: Newalls Insulation Company Limited, England

[21] Appl. No.: 68,027

[22] Filed: Aug. 20, 1979

Related U.S. Application Data

[63] Continuation of Ser. No. 972,306, Dec. 22, 1978, abandoned, which is a continuation-in-part of Ser. No. 750,358, Dec. 14, 1976.

[30] Foreign Application Priority Data

Jul. 9, 1979 [GB] United Kingdom ..... 23886/79

[51] Int. Cl.[3] ..... D21J 3/12

[52] U.S. Cl. ..... 162/227; 162/181 C; 162/218

[58] Field of Search ..... 162/218, 225, 227, 396, 162/398, 399, 181 C, 153, 407, 408; 100/237, 257, 208, 255, 116, 37, 95; 425/338, 356, 411, 412; 264/86, 87; 210/225, 400, 401

[56] References Cited

U.S. PATENT DOCUMENTS

| | | | |
|---|---|---|---|
| 247,909 | 0/1881 | Haynes | 100/208 |
| 256,904 | 0/1882 | Laass | 100/237 |
| 1,008,556 | 11/1911 | Pancoast | 100/257 |
| 1,536,163 | 5/1925 | Sutherland | 162/399 |
| 1,895,687 | 1/1933 | Rutishavser | 162/407 |
| 1,907,204 | 5/1933 | Laussucq | 162/227 |
| 1,920,481 | 8/1933 | Sutherland | 162/227 |
| 2,450,900 | 10/1948 | Lyall | 162/407 |
| 2,699,097 | 1/1955 | Binkley | 162/153 |
| 2,784,085 | 5/1957 | Denning | 162/227 |
| 3,056,718 | 10/1962 | Grissom et al. | 162/225 |
| 3,638,559 | 2/1972 | Parker | 100/208 |

*Primary Examiner*—Peter Chin

*Attorney, Agent, or Firm*—William A. Drucker

[57] ABSTRACT

A method of manufacturing sheet form insulation products from an aqueous slurry containing calcium silicate comprises the steps of pumping the slurry into a closed mould cavity in a platen filter press, at least one wall of the mould cavity being foraminous to an extent sufficient to allow the escape substantially only of fluid, stopping the pumping at a predetermined level of back pressure in the mould cavity, followed by closing the press to reduce at least one dimension of the mould cavity a prechosen amount.

4 Claims, 2 Drawing Figures

Figure 1:
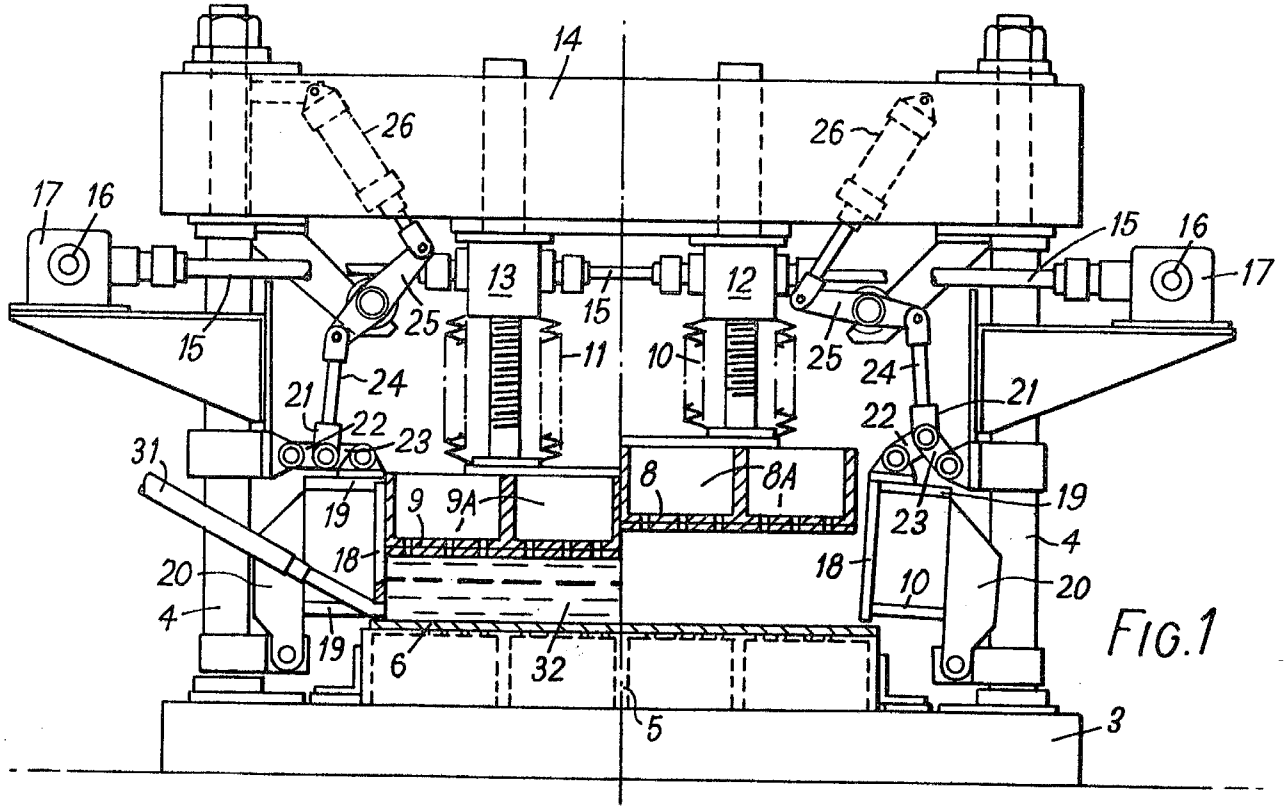

3
4
5
6
8
8A
9
9A
10
11
12
13
14
15
16
17
18
19
20
21
22
23
24
25
26
31
32

MANUFACTURE OF INSULATING PRODUCTS

This is a continuation of Ser. No. 972,306 filed Dec. 22, 1978 now abandoned. Ser. No. 972,306 is a continuation-in-part of Ser. No. 750,358, filed Dec. 14th 1976.

The present invention relates to the manufacture of sheet or slab form insulation products from relatively free flowing slurries, for example containing calcium silicate and/or fibre. In particular it relates to a filter press which can be used to make such products. It also relates to a method of making sheet or slab form insulation products.

Such products may be made by paper and/or board making techniques, they may also be made by filter pressing in which a measured volume of slurry is poured into a foraminous mould cavity and then dewatered by pressing.

Conventional platen presses can be used for this, but uneven pressure distribution and fluid leakage around the edges of the press platen tend to give a product of irregular thickness and density.

It is an object of the present invention to provide an improved filter press for manufacturing such sheet or slab form insulation products and it is a further object of the invention to provide an improved method for use with this press.

According to the invention, a filter press includes a pluratory of movable platen portions, each with individual actuating means which are adjustable relative to one another, but which are also controlled by a common drive arranged and adapted, in operation, to move all the platen portions substantially simultaneously as a single platen.

Preferably, the press further includes means defining a mould cavity, said means comprising sidewall members movable into and out of substantially sealing relation with the periphery of the platen portions as a whole together with an endless filter band so disposed as to constitute a face of the mould cavity directly opposed to the platen portions. Preferably, one sidewall member is also moveable in a direction away from the filter band so as to enable advancement of the filter band to carry a product out of the mould cavity. The filter band may be arranged to discharge the product onto a conveyor belt provided with length/width trimming apparatus for the product.

Advantageously, the platen portions are arranged side-by-side lengthwise of the press, each platen portion having a length substantially equal to the width of the product to be made the length of the press being its dimension in the direction of travel of the endless filter band. The individual actuating means may be screw jacks driven by a common drive shaft, to ensure that once the jacks have been adjusted to produce a product of uniform thickness, this setting will be accurately repeated for each succeeding product. Preferably at least four jacks and provided for each platen portion. Whilst the common drive shaft can be driven by any convenient means, such as an electric motor, it is particularly preferred that an air motor, or motors should be used. Air motors, being operated by air pressure alone, are capable of withstanding stalling or near-stalling conditions of operation; the ability to work under such conditions has proved to the especially advantageous in the operation of the press of the present invention. Furthermore, the stalling air motor acts as its own safety valve thereby reducing wear and tear on the screwjacks to some extent.

The use of screw jacks and a common drive shaft has the added advantage that the platen portions can be stopped at any point in their range of movement, without the need for fixed limit stops, as in a conventional platen press. It follows that all of the available pressure is applied to the product and not directly to the hardware of the press, thus allowing preselection of the finished product thickness.

Furthermore, the density of the product can also be controlled by adjusting the position of the platen portions prior to pumping the slurry into the mould cavity. Also, as will be further explained later, it has been found that the homogeneity of the final product can be controlled by controlling the rate of closure of the press. In particular, the form of control given by the use of air motors is very satisfactory in this respect.

It should be noted that having made one sheet or slab, the platen portions can be raised to create a new mould cavity on top of the first sheet or slab. A second sheet or slab can then be made on top of the first, using the same or a different slurry. It is thus possible to form laminated products wherein each layer is of different density and/or composition to the next layer.

According to a further aspect of the present invention, a method of manufacturing sheet or slab form insulation products from an aqueous slurry containing calcium silicate and/or fibre comprises pumping the slurry into a closed mould cavity in a platen filter press, at least one wall of the mould cavity being foraminous to an extent sufficient to allow the escape substantially only of fluid, stopping the pumping at a predetermined level of back pressure in the mould cavity, followed by closing the press to reduce at least one dimension of the mould cavity a prechosen amount. Advantageously, the press is closed by use of an air motor, or motors, the operating conditions of said motor being selected so that the motor approaches stalling speed as the prechosen amount of reduction of mould cavity dimension is reached. Preferably, further closure beyond the prechosen amount is inhibited by a pre-set limit switch, prior to actual stalling of the air motor. The result of such operation of the press has been found to be that the product is more homogeneous; the gradually reducing rate of closure as the air motor approaches stalling speed and as the prechosen amount of closure is approached significantly reduces the "skin" effect produced by over-rapid closure, as would be obtained on a conventional press closing onto fixed stop blocks. Such controlled closure would be difficult to attain with electric motors, unless a complex variable speed drive system were adopted. The use of air motors avoids the need for such complication. Positively pumping the slurry into the mould cavity up to a predetermined level of back pressure achieves firstly, a higher solids content in the mould cavity, coupled with a degree of de-watering prior to pressing. Secondly it makes for an improved control of both product density and regularity, since the volume of solids in the cavity prior to pressing can be controlled by selecting the appropriate back pressure.

The problem of leakage around the platen of a conventional platen press can be minimized by making the platen a close fit within the walls of the mould cavity. The latter may be simply a rectangular frame constituting four side walls, the bed of the press constituting the bottom wall and the platen constituting the top wall of the cavity. The bottom wall, that is the press bed, may be a filter cloth stretched over an apertured backing plate and the filter cloth may be in the form of an endless band or it may be static, but in either case removal of the product after pressing can be effected by raising the press platen clear of the cavity side walls prior to sliding the mould cavity out of the press. Where the mould cavity is in the form of a rectangular frame the method of the invention preferably therefore includes the additional step of opening the press at least sufficiently to enable the mould cavity to be withdrawn and/or inserted into the press, as appropriate. It should be noted in this context that the slurry is most conveniently supplied to the mould cavity through a supply aperture in the side walls of the cavity.

The desired back pressure can be controlled by using air pressure as the pumping medium, for example, by pressurising with air a stock chamber which supplies the mould cavity. When the back pressure in the mould cavity reaches the level of the air pressure the flow will naturally cease and this may be monitored either by suitable instrumentation or visually by an operative.

Although conventional filter presses can be used with relatively minor modifications to carry out the method of the invention, they tend to be massive in construction, especially where pressure has to be applied evenly over a large area to make a product of sensibly constant thickness. The use of fixed limit stops to control platen displacement inevitably results in the press frame being subjected to very heavy loading and it must, therefore, be built to withstand such loading.

It is therefore preferred that a filter press according to the present invention be used to carry out the method, particularly as the position of the platen portions can be adjusted to control product density, in addition to the control already effected by adjustment of the back pressure. Furthermore, the use of such a press operated by an air motor also enables full advantage to be taken of the near-stalling operation described earlier.

Figure 2:
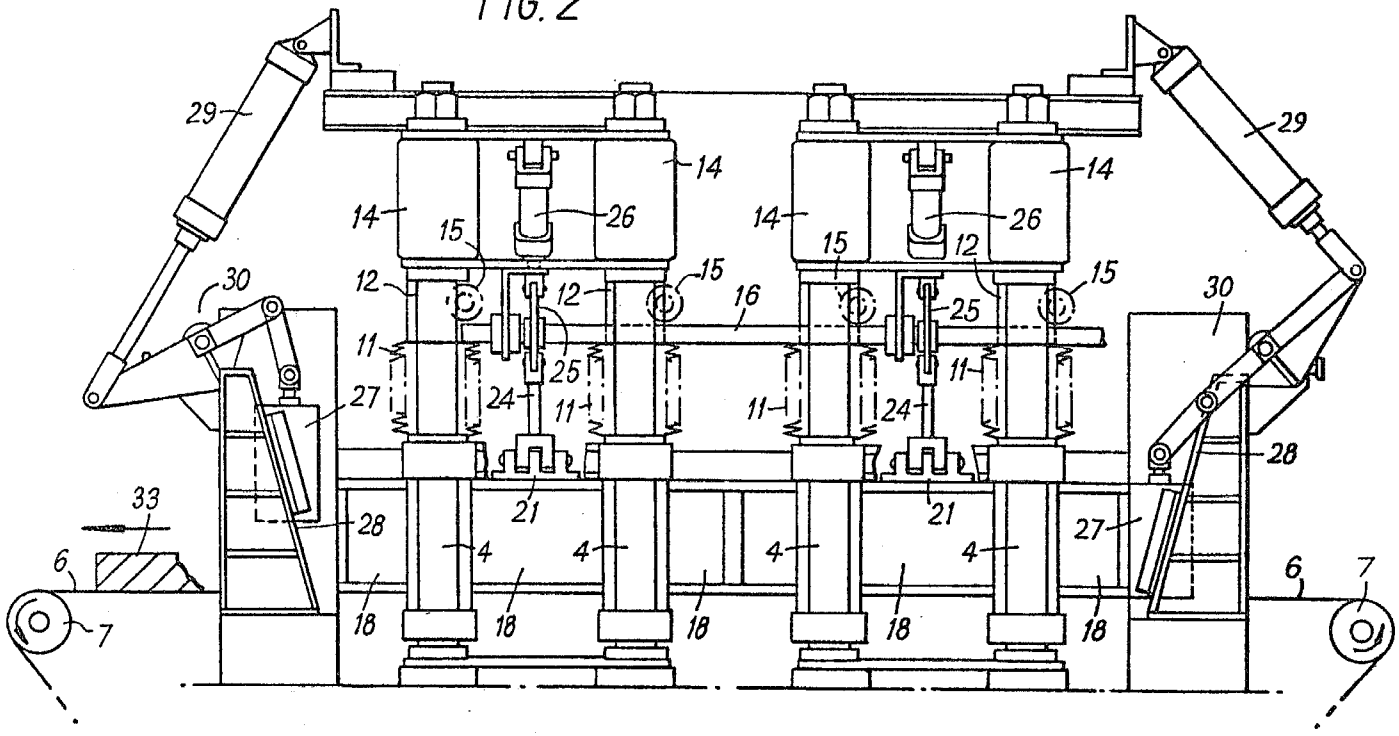

In order that the invention be better understood, a preferred embodiment of it will now be described by way of example with reference to the accompanying drawings in which:

FIG. 1 is an end view, partially in section, through a platen press according to the invention, the section being taken in a plane normal to the direction of travel of the filter band and, FIG. 2 is a side view of the press of FIG. 1.

For convenience, like reference numerals will be applied to like parts in both figures.

In the figures, the press comprises a fixed bed 3, supporting pillars which extend above the bed and carry other parts of the press. Mounted on the bed 3, an apertured staging 5 supports an endless filter cloth 6 mounted for circulation around end/drive rollers 7, shown only in outline in FIG. 2. Purely to illustrate the operation of the press, in FIG. 1 a single platen portion has been "split" along the centre line of the press into two parts, one part 8 is shown in an "up" or open position whilst the other part 9 is in a "fill position", as will be described later. Each platen portion is connected to four screw jacks, 10, 11, and, through the body of geared drives 12, 13 for the jacks, to a fixed cross bar 14, which is carried by the pillars 4. The geared drives 12, 13 are linked by drive shafts 15 to line shafts 16 which extend lengthwise of the press (i.e. normal to the plane of FIG. 1 and parallel to the plane of FIG. 2), right angle drive boxes 17 being provided on each side of the press. In the press shown in FIG. 2 there are two platen portions along the length of the press, each being similar and driven by the line shafts 16 in exactly the same way, a common drive motor (not shown) being provided at one end of the machine to rotate both line shafts through exactly the same angular distance, as required to operate the process and as will be discussed later. In this case, a reversible air motor was used to rotate the line shafts. It will be appreciated that the press may be lengthened by simply providing further platen portions of the same kind.

The downwardly-facing surfaces of each platen portion are covered by filter cloth (not shown) and the portions themselves are provided with aperatures, so that in use fluid expressed from the mould cavity below can escape into the troughs 8A, 9A defined between the upstanding walls of the platen portions.

Still referring to FIG. 1, at each side of the press, there is a sidewall constituted by a plate 18 connected by struts 19 to a hinge member 20, which is pivoted to the pillar 4. The free end of the hinge member is connected through a toggle mechanism 21 comprising two linages 22, and 23, the latter pivotably connected to the pillar 4 and the former pivotably connected to the hinge member 20. The connection between the linkages is itself pivotably connected through a follower 24, and a lever 25 to a pneumatic cylinder 26. Both sides of the press are identical in this respect, but for convenience, the left-hand side sidewall, in FIG. 1 is shown in the "closed" position whilst the right-hand sidewall is in the "open position", although in normal operation, this would not be the case and both sidewalls would be either open or closed.

Referring now to FIG. 2, at each end of the press, there is a further sidewall 27, the right-hand one being shown "closed" and the left-hand one "open". The sidewalls 27 are mounted for sliding movement along guides 28 which cause them to follow a path away from the filter band and the platen portions. Pneumatic cylinders 29 operate each of the sidewalls 27 through a lever arrangement and linkage, generally indicated at 30.

The operation of the press in carrying out a preferred embodiment of the method of the invention will now be described briefly with reference to the Figures.

Initially, the filter band is stationary, all of the sidewalls 18 and 27 are in the "closed" position and the screwjacks have been operated to put the platen portions into the "fill" position of FIG. 1. An aqueous slurry containing calcium silicate and/or fibre is then pumped into the mould cavity defined between the side walls, the platen portions and the filter band, using a flexible pipe 31 (FIG. 1) connected to an aperature in the left-hand sidewall 18. The slurry is pumped into the cavity until the back pressure due to the accumulation of solids in the cavity 32 is approximately equal to the pumping pressure and the rate of inflow of slurry decreases to zero, or nearly zero.

When the back pressure and pumping pressure reach equilibrium, a condition assessed by monitoring the rate of inflow, (or the rate of fluid escape from the cavity) the supply is cut-off and the screw jacks are operated by the air motor to move both the platen portions downwardly to reduce the vertical dimension of the cavity to the desired product thickness whilst at the same time de-watering the material in the cavity. The air pressure applied to the air motor is adjusted so that as the press closes, reducing the vertical dimension of the cavity, the motor approaches stalling speed as the desired final product thickness is reached, further closure being inhibited by one of the platen portions tripping a limit switch (not shown) set to correspond to the desired thickness. After allowing time for drainage of the expressed fluid, the platen portions can be retracted to the "open" position, together with the sidewalls. The filter band can then be moved in the direction indicated by an arrow in FIG. 2 to displace the product 33 clear of the press and on to further processing, e.g. trimming and oven drying. The cycle can then be repeated.

Because the platen portions are individually operated each by four jacks and adjustable relative to one another the products made on a platen press of the kind just described can have greatly improved regularity, in particular as regards their thickness and overall flatness. Also, because the rate of closure of the press was automatically reduced by the air motor approaching its stalling speed, the rate of expression of the fluid was reduced in like manner, so that surface flow marking ("skin" effect) in the product was significantly reduced, if not eliminated. Any tendency for the pressing operation to produce an uneven thickness and/or slight curvatures requiring smoothing treatments such as sanding or planing can be compensated for by adjusting individual screw jacks. Also, because the pressure is inherently distributed evenly over the whole platen area, the frame of the press need not be as massive as would be required in a single hydraulic rampress of the conventional kind. As many platen portions as are required to make a given product length may be used. Drainage of the expressed fluid from the troughs 8A, 9A formed by the platen portions can be augmented by mounting the press with one end slightly higher than the opposite end, thereby enabling the fluid to be readily removed by gravity, although the exact amount of tilt will depend on the volume of fluid to be removed, the latter being, of course, related to the nature of the slurry as well as to the size/thickness/density of the product.

The rate of drainage can also be increased by pumping the expressed fluid from the troughs 8A and 8B. This is useful when a second sheet or slab is made on top of another slab, because a major part of the fluid will have to escape upwards into these troughs, the first-formed sheet or slab being relatively impermeable. This auxiliary pumping does not significantly affect the improved homogeneity achieved by use of an air motor since it does not affect the near-stalling operation of the air motor; it merely facilitates removal of already-expressed fluid.

What I claim is:

1. A method, of manufacturing sheet from insulation products from an aqueous slurry containing calcium silicate and fibers, utilizing a platen filter press having a mold cavity defined by a mold and a movable platen constituted by a plurality of platen portions which form a single unitary pressing surface, said platen portions being adjustable with respect to one another so as to apply pressure evenly upon the slurry in the mold cavity, said mold being foraminous to an extent sufficient to allow the escape substantially only of liquid of the slurry, said method comprising the steps of:

(i) pumping said slurry into said mold cavity at a prechosen pressure until the back pressure exerted by the deposition of solids of the slurry in the mold cavity balances said prechosen pressure to terminate the pumping, (ii) thereafter moving said platen relative to said mold to press the slurry in the mold and reduce the slurry in at least one dimension by a prechosen amount.

2. The method claimed in claim 1 wherein pumping of the slurry is obtained by using air pressure to displace the slurry into the mold cavity, the air pressure corresponding to said prechosen back pressure.

3. The method claimed in claim 1 or in claim 2, wherein said platen is movable by means of an air motor, said motor being powered such that, as the reduction of the slurry reaches said prechosen amount, the motor approaches stalling condition.

4. The method claimed in claim 3 wherein, as said reduction of the slurry progresses, the rate of reduction is progressively reduced as a result of the motor approaching said stalling condition, whereby the surface homogeneity of the product is improved by progressive reduction of the rate of expulsion of its liquid from the slurry.

* * * * *